United States Patent [19]

Leahy

[11] 4,357,769

[45] Nov. 9, 1982

[54] PICTURE FRAME WITH ROTATABLE EASEL

[75] Inventor: David J. Leahy, Framingham, Mass.

[73] Assignee: Dennison Manufacturing Company, Framingham, Mass.

[21] Appl. No.: 243,172

[22] Filed: Mar. 12, 1981

[51] Int. Cl.[3] ..... G09F 1/00; A47G 1/06; A47B 97/04

[52] U.S. Cl. ..... 40/152.1; 40/124.1; 248/463; 248/459; 248/460

[58] Field of Search ..... 40/152.1, 152, 152.2, 40/153, 154, 155, 156, 157, 124.1, 120; 248/463, 464, 465, 459, 460, 458, 467, 441 R

[56] References Cited

U.S. PATENT DOCUMENTS

| | | | |
|---|---|---|---|
| 1,767,753 | 6/1930 | Frieberg | 248/459 |
| 1,993,947 | 3/1935 | Rosenberg et al. | 248/463 |
| 2,238,415 | 4/1941 | Farr et al. | 248/459 |
| 2,730,324 | 1/1956 | Taylor | 40/124.1 |
| 3,186,117 | 6/1965 | Detje | 40/152.1 |
| 3,355,828 | 12/1967 | Betz | 40/152.1 |
| 3,707,791 | 1/1973 | Levy | 40/152.1 |

FOREIGN PATENT DOCUMENTS

| | | | |
|---|---|---|---|
| 248666 | of 1926 | United Kingdom | 248/463 |

*Primary Examiner*—Gene Mancene
*Assistant Examiner*—Michael J. Foycik, Jr.
*Attorney, Agent, or Firm*—Barry D. Josephs; George E. Kersey; Arthur B. Moore

[57] ABSTRACT

A picture frame for photographic snapshots having a rotatable easel of thin, lightweight construction mounted to the back side of the picture frame. The easel has a substantially trapezoidal shape when folded and has rectangular front and back panels having a common top edge and collapsible, triangular side panels interconnecting the front and back panels. The side panels may be folded, collapsing the easel into a flat structure for easy packaging and shipment. The side panels when unfolded form an easel for holding the picture frame in a stable, secure, upright position on a tabletop. The easel design of the invention produces an unusually stable structure for its weight. It does not collapse upon moving the picture frame in any direction on the table surface. The easel may be rotated to permit display of snapshots in either a horizontal or vertical orientation.

16 Claims, 3 Drawing Figures

PICTURE FRAME WITH ROTATABLE EASEL

BACKGROUND OF THE INVENTION

1. Field of the Invention

The present invention relates to a picture frame for snapshots having a rotatable easel mounted on the back side of the picture frame for holding the frame in a secure, stable, upright position on a table surface.

2. Description of the Prior Art

The prior art discloses a wide variety of snapshot picture frames and easels. The frame can be made of a variety of materials including a wide range of plastics, cardboard, and metals.

The easel which is most commonly used is normally constructed of a heavyweight cardboard material or of metal. The easel is normally a flat slab which is attached by a hinge to the back surface of the picture frame. The easel slab typically has tapered or beveled edges along its free end permitting the frame to be oriented in either a vertical or horizontal position when placed upright on a tabletop. Since the easel slab is connected to the back side of the picture frame by a hinge, the easel tends to be unstable when the upright picture frame is moved or pushed even slightly. Even a slight agitation often causes the easel to collapse and the frame to fall from its upright position on the tabletop. Also since the material used for hinged easels is often of heavy thick material, the inclusion of such easels adds considerably to the overall cost, weight and thickness of the picture frame as a whole.

In view of the disadvantages of hinged easels, applicants have produced a low-cost, easily fabricated snapshot frame and easel of thin, lightweight construction, preferably of lightweight cardboard construction, which incorporates a novel design of the easel avoiding the need for a hinge. The novel easel design of the invention does not collapse upon moving the upright picture frame on the table surface.

SUMMARY OF THE INVENTION

It is an object of the present invention to provide a display device for photographic snapshots which is of compact, lightweight construction, which may be securely set upright on a flat table surface and easily foldable for shipment and storage.

It is an important object to provide a display device for use as a picture frame having an easel of thin, lightweight construction which holds the picture frame in a secure, stable, upright position on a tabletop and which does not collapse upon moving the picture frame in any direction on the table surface.

It is a further object of the invention to provide a picture frame of thin, lightweight construction having an easel which is manually rotatable so that the picture frame can be positioned on a tabletop in either a horizontal or vertical orientation.

The picture frame of the present invention is particularly suitable for holding photographic snapshots and is comprised of a mounting member such as a flat, rectangular backing surface surrounded by a rectangular frame border and an easel rotatably mounted to the back side of the mounting member. The frame border and backing surface are preferably of a thin, lightweight rectangular cardboard construction, but the invention is applicable to frames and backing of oblong or polygonal shape of any thickness and weight.

The easel is a novel stand, substantially trapezoidal in shape in its folded position. The easel is comprised of rectangular or trapezoidal shaped front and back panels which intersect along a common top edge and at least one collapsible side panel, preferably a pair of collapsible side panels interconnecting the front and back panels. The collapsible side panels are preferably of triangular shape having one or more folds running along their length forming foldable bellows between the front and back panels. The bellows permit the easel to be folded into a compact flat structure when not in use, thus permitting easy handling and packaging in shipment.

When unfolded, the easel provides a surprisingly stable, secure support for the snapshot picture frame when placed upright on a table surface, even though the easel is constructed of a think, lightweight material such as cardboard. The easel is rotatably mounted at a point on the back side of the frame which is perpendicularly equidistant from two adjacent edges of the frame border and preferably along an axis of symmetry equidistant from two opposite long edges of the frame border.

The invention has the particular advantage of ease of fabrication and low material costs since cardboard may be used. The picture frame has an aesthetically attractive, stable, three-dimensional appearance when set upright. Despite its thin, lightweight cardboard construction, the easel holds the picture frame in a secure, stable, upright position and does not collapse upon moving the picture frame in any direction on the table surface.

DESCRIPTION OF THE PREFERRED EMBODIMENT

Figure 1:
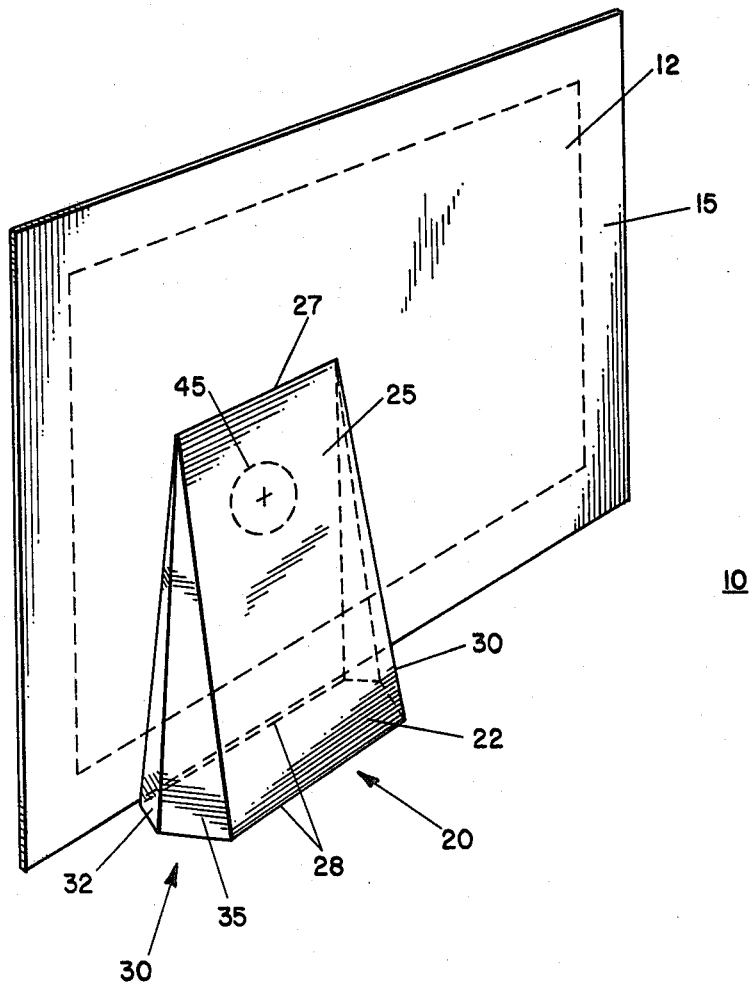
FIG. 1 is an isometric illustration of the easel as attached to the picture frame.

A preferred embodiment of the picture frame of the invention is shown illustrated in FIG. 1. The picture frame 10 of the invention is preferably of rectangular shape and is best illustrated in FIG. 1. Picture frame 10 is comprised of a mounting member such as a backing surface 12 surrounded by a frame border 15 and an easel 20. Easel 20 is rotatably mounted on the back side of backing surface 12. Backing surface 12 is a flat surface composed of cardboard, plastic or fibrous material. Preferably backing surface 12 is of a cardboard or a laminated cardboard construction. Backing surface 12 may also be constructed of a flat cardboard surface coated on its front side with a lacquer or polymer coating, or covered with a fabric. The front side of backing surface 12 is adapted to receive snapshot pictures and the like which are held in position by placing the pictures flush against the front side of backing surface 12 and inserting the picture edges between frame border 15 and the front side of backing surface 12.

Frame border 15 is preferably composed of a pigmented cardboard material coated with a lacquer or polymer film such as polyethylene to give it a colorful and glossy appearance. Although a lightweight cardboard construction is preferred for frame border 15, other materials such as plastic, metal or wooden materials may be used. The frame border 15 may have any desired depth, but preferably it is of flat, lightweight construction which lowers the manufacturing cost and requires less space for packaging and shipment. During packaging and shipment easel 20 is folded to lie flat against backing surface 12 so that frame 15, backing surface 12 and easel 20 form a lightweight picture frame structure which is relatively thin, typically only about ⅛ inch thick.

Figure 2:
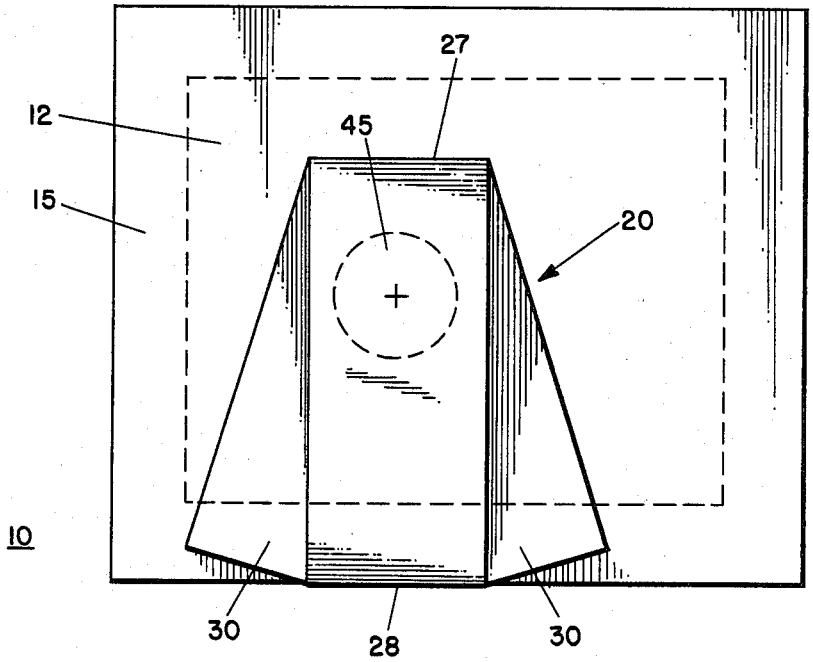
FIG. 2 is a plan view of the easel oriented in a position perpendicular to a long side of the picture frame.
Figure 3:
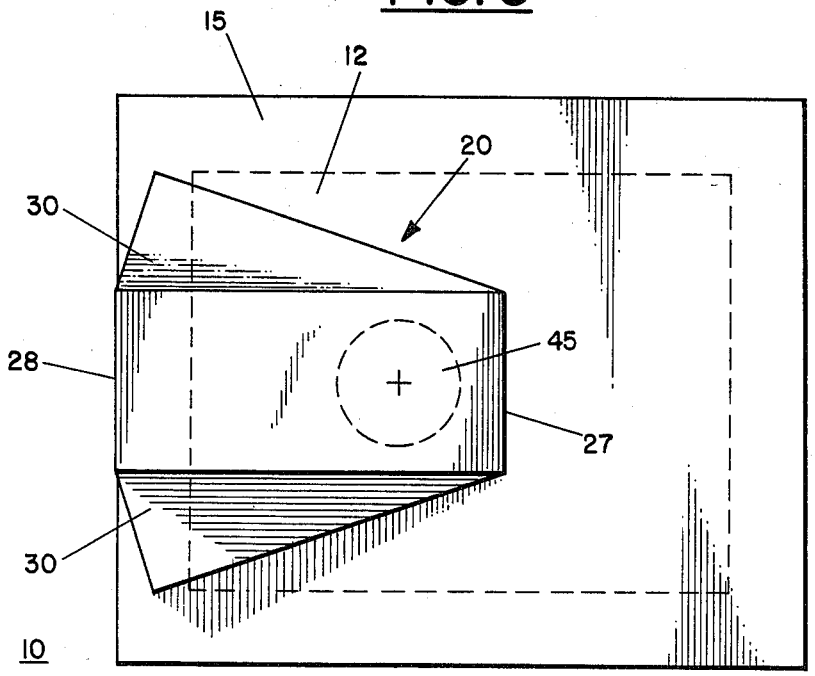
FIG. 3 is a plan view of the easel oriented in a position perpendicular to a short side of the picture frame.

Easel 20 appears substantially as a trapezoid when viewed in its folded position as illustrated in FIGS. 2 and 3. Easel 20 is rotatably mounted onto the back side of backing surface 12 and is comprised of a front panel 22 and a back panel 25 which intersect along a common edge 27. The front panel 22 and back panel 25 are preferably of rectangular or other shapes. The easel also includes at least one and preferably a pair of triangular panels 30 interconnecting the front and back panels 22 and 25 respectively. Side panels 30 have one or more folds running along their length forming collapsible bellows 35 and 32. Side bellows 32 and 35 allow front panel 22 to be folded to lie flush against back panel 25 as best illustrated in FIGS. 2 and 3 forming a flat, thin surface, which permits convenient storage and shipment of the picture frame. The easel is easily opened from its storage position by pulling front panel 22 away from back panel 25 along base edge 28. As the surfaces 22 and 25 are pulled apart, side bellows 32 and 35 on each side of the easel become unfolded to an extended position as best illustrated in FIG. 1. When the bellows 32 and 35 are at least substantially unfolded, the picture frame 10 may then be set in an upright position on a flat desk or table surface with the base of the opened easel resting flush against the flat table surface. Because of the resiliency of the cardboard, the easel when pulled open reaches an equilibrium point somewhat short of the point of maximum extension. Thus at its equilibrium point an angle of less than about 20 degrees approximately between about 5 and 20 degrees with the base of the bellows and surface of the table top is formed. Easel 20 renders particularly stable support for the picture frame, and when opened does not collapse upon moving the upright picture frame in any direction on the table surface.

Surprisingly, applicants have found that even though easel 20 may be of lightweight construction, e.g. preferably having a cardboard basis weight of about 223 to 275 lbs. per ream (3000 sq. ft. per ream), the novel easel configuration provides a very stable support despite its light weight for picture frames of weight typically up to 0.4 grams per square inch to 10 grams per square inch and higher. Also by increasing the basis weight of the cardboard used in forming the easel or substituting heavier materials for the easel construction such as multiple ply cardboard, the novel easel design of the invention is readily adaptable to support heavier picture frames including shapshot picture frames of metal construction and will not collapse upon moving the upright picture frame in any direction on the table surface. Typically the picture frame has overall dimensions approximately 6 inches by 5 inches, but it should be understood that the invention is applicable to frames of any dimension, or to units comprised of clusters of individual frames. When small picture frames typically having dimensions 5 inches by 6 inches are used, the easel may have dimensions of the front and back panels 22 and 25, typically of about 2 inches by 3 inches and triangular side panels 30 having a base of about 2 inches.

The surfaces of the easel comprising front panel 22 and back panel 25 and side surfaces 30 are preferably formed of a single sheet of cardboard which is folded to form the tapezoidal-wedge shape illustrated in FIG. 1. Back panel 25 may be easily secured to side panels 30 by using adhesive to secure overlaying flaps (not shown) located between surfaces 25 and 30.

Easel 20 is rotatably mounted to backing surface 12 by use of a fastener 45. Fastener 45 may be a conventional fastener means for holding the easel securely to the backing surface 12, but yet permitting manual rotational movement of the easel. A fastener 45 comprised of a capped round knob or protrusion (not shown) emanating from the backing surface 12 and penetrating through back panel 25 of the easel provides a suitable fastening means. The fastener 45 may also be comprised of a cap extending through the back panel 25 of the easel and attached at one end directly to the backing surface 12 of the picture frame and at the other end covering a portion of the inside of said back panel 25 thus holding the easel in place, but yet permitting rotation of the easel around the cap.

Fastening means 45 is located on the back of the picture frame 10 at a point perpendicularly equidistant from one long edge and one adjacent short edge of the frame. Preferably the fastening means is also located along an axis of symmetry equidistant from the two opposite long edges of the frame border 15 preferably equidistant from two opposite long edges of border 15.

In use the picture frame can be placed on a table top in either a horizontal upright position or in a vertical position in order to display pictures in either horizontal or vertical orientation, simply by rotating the easel so that its axis lies perpendicular respectively to either the long edge of the picture frame as in FIG. 2 or perpendicular to the short edge as in FIG. 3. Since fastening means 45 is positioned at a point perpendicularly equidistant from both the short edge of the frame and an adjacent long edge, the base edge 28 of the easel can be brought to rest in flush alignment with a long edge of the frame or an adjacent short edge by simply rotating the easel to either one of these positions as illustrated in FIGS. 2 and 3 respectively. When the easel is rotated to an alignment perpendicular to a short edge of the frame as shown in FIG. 2 and the bellows 32 and 35 are unfolded, the easel will support the picture frame securely on a table top with a short edge of the frame positioned against the table top. Likewise when the easel is rotated to an alignment perpendicular to a long edge of the frame as shown in FIG. 3, the easel will support the picture frame securely on a table top with a long edge of the frame positioned against the table top. Thus snapshots may be displayed in either horizontal or vertical orientation by setting the easel as illustrated respectively in FIGS. 2 and 3. The height of the easel above the fastening means can be extended as high as desired up to the borderline of the frame and similarly the width of the easel may be extended up to the borderline of the frame. Easels of such increased heights and widths provide added stability for heavy frames, e.g., metal frames, or when using very large frames.

While the present invention has been described with reference to a rectangular shaped picture frame, it should be appreciated that the picture frame may assume a variety of other shapes, and the novel easel of the invention is not limited to use in picture frames, but may be used to hold any display device securely on a flat surface. Therefore, the invention is not intended to be limited by the description in the specification but only by the language of the claims and equivalents thereof.

I claim:

1. A display device for snapshots and the like which comprises:

a mounting member and stand attached to said mounting member, said stand comprising a first panel and a second panel intersecting to form a common edge, and a collapsible side panel interconnecting the first and second panels, and means for rotatably mounting the stand to a surface of said mounting member, wherein said means is located on the surface of said mounting member at a point about perpendicularly equidistant from two substantially adjacent edges of the mounting member, the stand rotatable to a position perpendicular to either of said edges, said stand securely holding the mounting member in alternative upright display positions on a flat surface with either of said edges in contact with the flat surface.

2. A display device as in claim 1 wherein said collapsible side panel has at least one fold therein to provide a bellows effect.

3. A display device as in claim 1 wherein said stand further includes a second collapsible side panel opposite said first collapsible side panel, said second collapsible side panel interconnecting the first and second panels.

4. A display device as in claim 1 wherein said first panel is in contact with a surface of said mounting member.

5. A display device as in claim 1 wherein the stand is formed of a single sheet.

6. A display device as in claim 3 wherein the collapsible side panels are of triangular shape.

7. A display device as in claim 1 wherein the first and second panels of the stand are substantially rectangular in shape.

8. A display device as in claim 1 wherein the mounting member is of rectangular shape and the means for rotatably mounting the stand to a surface of said mounting member is located at a point along an axis of symmetry equidistant from two opposite edges of the frame border.

9. A display device as in claim 5 wherein the stand is comprised of cardboard material having a basis weight of between about 223 and 275 lbs. per ream.

10. A display device as in claim 1 wherein the means for rotatably mounting the stand to a surface of said mounting member comprises a cap extending through the first panel of the stand and attached at one end directly to a surface of said mounting member and at the other end covering a portion of the inside of said first panel so that the stand is held securely in place but yet permitting manual rotation of the stand around said cap.

11. In a display device having a mounting member and a stand attached to said mounting member, said stand holding the mounting member in an upright position on a flat surface when the stand is opened, the improvement comprising:

the stand comprising a first panel and a second panel intersecting to form a common edge and a collapsible side panel interconnecting the first and second panels, and means for rotatably mounting the stand to a surface of said mounting member, wherein said means is located on the surface of said mounting member at a point about perpendicularly equidistant from two substantially adjacent edges of the mounting member, the stand rotatable to a position perpendicular to either of said edges, said stand securely holding the mounting member in alternative upright display positions on a flat surface with either of said edges in contact with the flat surface.

12. A display device as in claim 11 wherein said stand further includes a second collapsible side panel opposite said first collapsible side panel, said second collapsible side panel interconnecting the first and second panels.

13. A display device as in claim 12 wherein the collapsible side panels have at least one fold therein to provide a bellows effect.

14. A display device as in claim 11 wherein the stand is of single piece construction.

15. A display device as in claim 12 wherein the collapsible side panels are of triangular shape.

16. A display device for snapshots and the like which comprises:

a mounting member and stand attached to said mounting member, said stand comprising:

a first panel and a second panel intersecting to form a common edge, and a collapsible side panel interconnecting the first and second panels, and means for rotatably mounting the stand to a surface of said mounting member, the stand rotatable from a position perpendicular to one edge of said mounting member to a position perpendicular to another edge of said mounting member, the stand securely holding the mounting member in alternative upright display positions on a flat surface with either of said edges in contact with the flat surface.

* * * * *